US006880271B2

(12) United States Patent
Caeran

(10) Patent No.: US 6,880,271 B2
(45) Date of Patent: Apr. 19, 2005

(54) BOOT

(75) Inventor: Marco Caeran, Montebelluna (IT)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/176,686

(22) Filed: Jun. 24, 2002

(65) Prior Publication Data

US 2003/0000110 A1 Jan. 2, 2003

(30) Foreign Application Priority Data

Jun. 29, 2001 (FR) ..... 01 08782

(51) Int. Cl.[7] ..... A43B 23/26
(52) U.S. Cl. ..... 36/54; 36/51
(58) Field of Search ..... 36/54, 51, 50.1, 36/50.5

(56) References Cited

U.S. PATENT DOCUMENTS

| | | | | | |
|---|---|---|---|---|---|
| 197,517 | A | * | 11/1877 | Johnson | 36/51 |
| 436,544 | A | * | 9/1890 | Rapp | 36/51 |
| 811,316 | A | * | 1/1906 | McPherson | 36/170 |
| 1,638,339 | A | * | 8/1927 | Johnson | 36/50.1 |
| 4,308,672 | A | * | 1/1982 | Antonious | 36/50.1 |
| 4,451,995 | A | | 6/1984 | Antonious | 36/51 |
| 4,811,497 | A | * | 3/1989 | Merino Ciudad | 36/51 |
| 5,365,679 | A | | 11/1994 | Chemello | 36/117 |
| 5,970,629 | A | | 10/1999 | Tucker et al. | 36/51 |
| 6,367,169 | B1 | * | 4/2002 | Barret | 36/51 |
| 6,474,000 | B1 | * | 11/2002 | Burt | 36/50.1 |

FOREIGN PATENT DOCUMENTS

| | | | |
|---|---|---|---|
| FR | 1356453 | | 3/1964 |
| GB | 2053657 | * | 2/1981 |
| WO | WO01/35784 | | 5/2001 |

* cited by examiner

*Primary Examiner*—Ted Kavanaugh
(74) *Attorney, Agent, or Firm*—Greenblum & Bernstein, P.L.C.

(57) ABSTRACT

A boot including an upper overlaying a sole, the upper having an opening extended by a slit, the slit extending between a lateral quarter and a medial quarter. An elastic panel of the boot blocks the slit at least partially, the elastic panel being stretched between the lateral quarter and the medial quarter.

46 Claims, 2 Drawing Sheets

BOOT

CROSS-REFERENCE TO RELATED APPLICATIONS

This application is based upon French Patent Application No. 01.08782, filed Jun. 29, 2001, the disclosure of which is hereby incorporated by reference thereto in its entirety, and the priority of which is hereby claimed under 35 U.S.C. §119.

BACKGROUND OF THE INVENTION

1. Field of the Invention

The invention relates to a boot, namely a sports boot and, more particularly, to a boot adapted to be removably retained on a sports apparatus.

2. Description of Background and Relevant Information

A boot of the aforementioned type can be used in a field such as snowboarding, skiing, water skiing, snowshoeing, roller skating, ice skating, skateboarding, mountain climbing, walking or the like.

Each boot has an upper that overlays a sole. The upper has an opening, which is extended by a slit to facilitate the passage of a user's foot.

Traditionally, the slit extends between a lateral quarter and a medial quarter. The slit allows for a relative spacing apart of the quarters. A tongue blocks the slit at least partially when the quarters are brought close together.

In the case where the tongue is housed between the quarters while being attached to the upper only at one end, foreign bodies, such as water or dirt, sometimes penetrate into the upper through the slit. In order to overcome this drawback, it has been proposed to have two pleats, one between the tongue and the lateral quarter, and the other between the tongue and the medial quarter. In this case, foreign bodies are prevented from penetrating into the upper through the slit. Nonetheless, foreign bodies can get housed in folds formed by the bellows and hinder the tightening of the upper.

SUMMARY OF THE INVENTION

An object of the invention, in particular, is to improve the resistance of a boot to the penetration of foreign bodies in to the upper through the slit, or to the accumulation of foreign bodies in the folds of a pleat.

To this end, the invention proposes a sports boot having an upper that overlays a sole, the upper having a high opening that is extended by a slit, the slit extending between a lateral quarter and a medial quarter.

An elastic panel of the boot blocks the slit at least partially, the elastic panel being stretched between the lateral quarter and the medial quarter.

The elastic panel joins the lateral and medial quarters to one another by being constantly stretched regardless of the distance between the quarters. As a result, the penetration of foreign bodies into the upper through the slit is avoided, and the accumulation of foreign bodies in the folds of a pleat is also avoided.

One advantage that results from this is an enjoyable use of the boot. In addition, the elastic panel confers an unusual and pleasant appearance to the boot.

BRIEF DESCRIPTION OF DRAWINGS

Other characteristics and advantages of the invention will be better understood from the following description, with reference to the attached drawings showing, according to non-limiting examples, how the invention can be embodied, and in which.

DETAILED DESCRIPTION OF THE INVENTION

The examples, which will be described hereinafter, relate more particularly to snowboard boots. Nevertheless, the invention applies to other fields, such as those mentioned previously.

Figure 1:
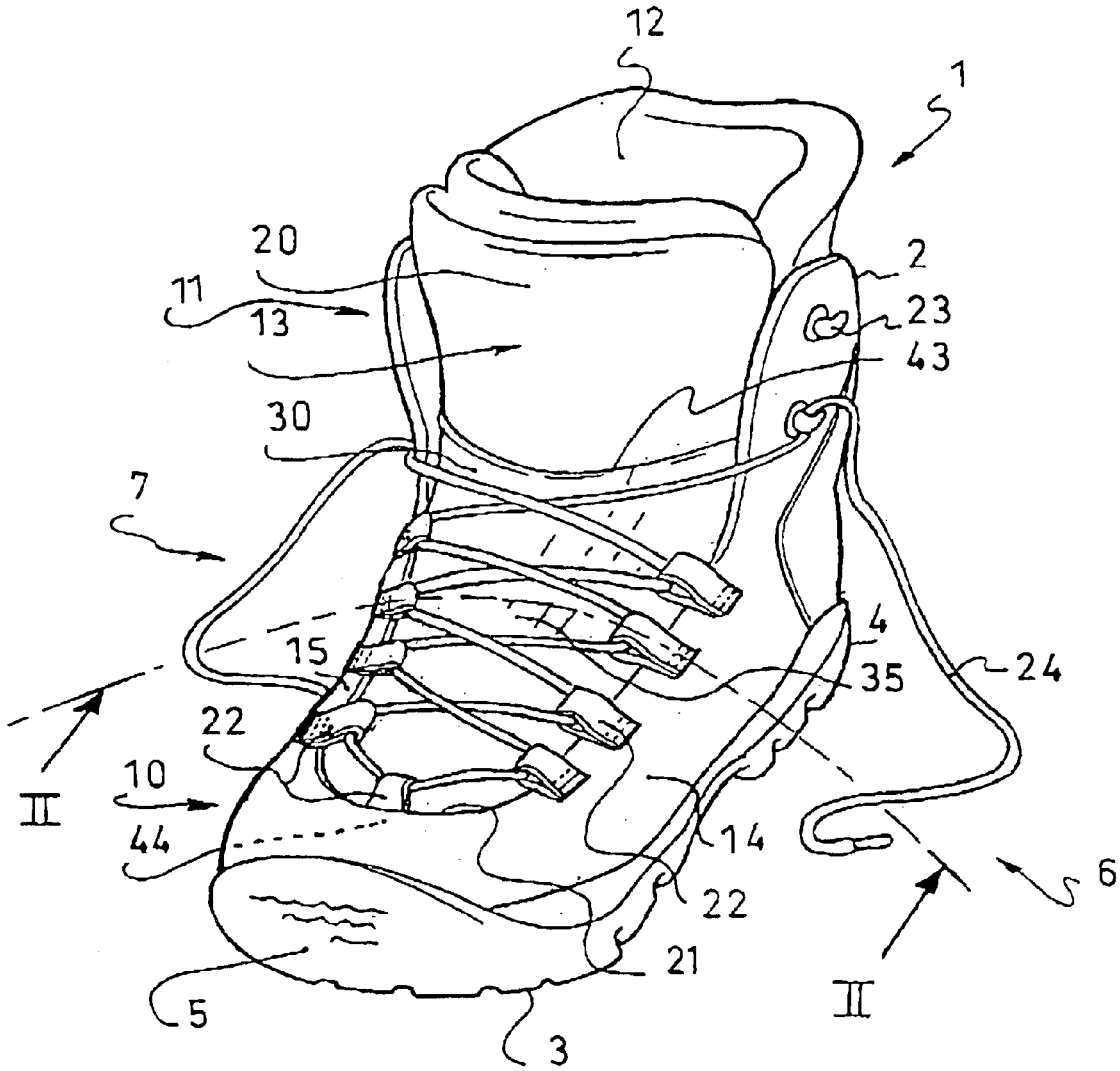
FIG. 1 is a front perspective view of a boot, according to a first embodiment of the invention.

According to the first example as shown in FIG. 1, a snowboard boot 1 is provided to receive the user's foot.

In a known manner, the boot 1 has an upper 2 that overlays a sole 3. The boot 1 extends lengthwise between a heel 4 and a front end 5, and widthwise between a lateral side 6 and a medial side 7. The upper 2 has a low portion 10 provided to surround the foot, and a high portion 11 provided to surround part of the lower leg.

The boot 1 is structured to allow a good foot rolling movement when walking and a leaning of the lower leg when steering a board. That is the reason why the sole 3 and the upper 2 are relatively flexible.

However, the boot can be provided to be more rigid to facilitate certain styles of steering or sports.

A symmetrical opening 12 of the upper 2 is extended toward the front by a slit 13, the latter extending between a lateral quarter 14 and a medial quarter 15 of the upper 2. The slit 13 allows a relative spacing of the quarters 14, 15 from one another, which facilitates putting the boot on or taking it off. The slit 13 is substantially blocked by a tongue 20 that extends from the base 21 of the slit 13 up to the top of the upper 2.

The tongue could be provided not to extend up to the top of the upper 2. Alternatively, a boot without a tongue could be provided.

Whatever the case, a tightening means enables the upper 2 to be tightened and untightened.

The tightening means, for example, has low keepers 22 spread over the lateral 14 and medial 15 quarters and, optionally, in the area of the base 21 of the slit 13.

The low keepers are represented in the form of a loop, respectively, obtained by folding a portion of a strap in which a bushing having a low coefficient of friction can be housed. Alternatively, other types of keepers can be used.

The tightening means also has high keepers 23 spread over the top portion 11 of the upper 2, on the lateral side 6 and on the medial side 7. The high keepers 23 are represented in the form of hooks.

It is to be understood that other structures could be provided in order to obtain the low 22 and high 23 keepers.

The tightening means also has a lace 24 that follows a path determined by the keepers 22, 23. For example, the lace 24 alternatively connects a keeper located on the lateral side 6 to a keeper located on the medial side 7, in the low portion 10 as well as in the top portion 11 of the upper 2. The lace 24 also traverses the low keeper 22 located in the area of the base 21.

Other paths can be envisioned for the lace 24. In any case, a tensioning of the lace 24 allows a tightening of the upper 2 through a mutual bringing together of the lateral 14 and medial 15 quarters of the upper 2.

Other structures could be provided for the tightening means, such as a series of loops or buckles associated to levers on one side of the boot, and hooks for receiving the loops or buckles on the other side of the boot.

According to the invention, an elastic panel 30 blocks the slit 13 at least partially, the elastic panel 30 being stretched between the lateral quarter 14 and the medial quarter 15.

The elastic panel 30 is located under the tightening means of the upper 2.

Figure 2:
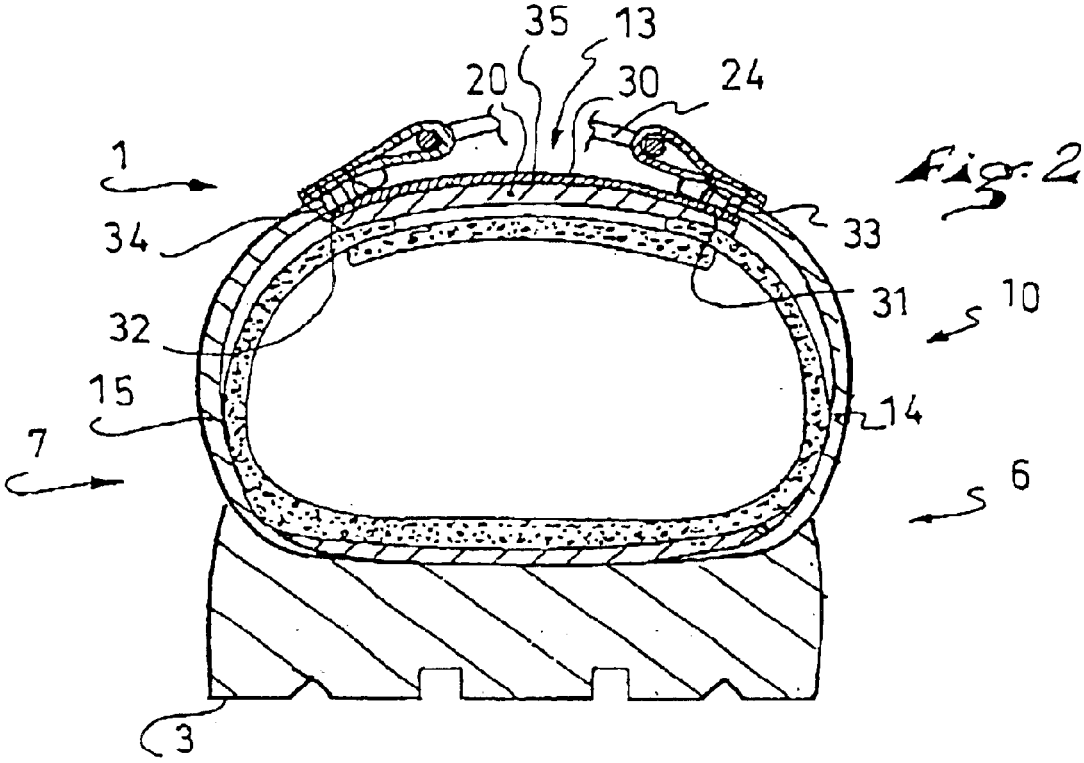
FIG. 2 is a cross-section along the line II—II of FIG. 1.

As shown better in FIG. 2, the elastic panel 30 extends widthwise between a lateral edge 31 and a medial edge 32.

An attaching means, shown in the form of a stitching 33, affixes the lateral edge 31 of the panel 30 to the lateral quarter 14 of the upper 2.

Similarly, an attaching means, shown in the form of a stitching 34, affixes the medial edge 32 of the panel 30 to the medial edge 15 of the upper 2.

Naturally, each attaching means could be made in a different manner, by gluing for example, or by any type of mechanical assembly, or by a combination of these means.

Each of the lateral 31 and medial 32 edges of the panel 30 is located under a lateral 14 or medial 15 quarter, respectively, of the upper 2.

However, it could have been provided that each edge 31, 32 of the panel 30 be above the corresponding quarter 14, 15, or butted against the quarter 14, 15.

Whatever the case, a central portion 35 of the elastic panel 30 extends between the lateral 14 and medial 15 quarters. In the example shown, the panel 30 is in contact with the tongue 20. However, this is not necessary.

In a complementary and optional manner, a liner 40 is inserted in the upper 2. The liner 40 has a slit 41 and a tongue 42, for example. The liner 40 can be used to improve the comfort of the boot 1, or it can fulfill other functions.

In referring back to FIG. 1, the elastic panel 30 extends lengthwise from a rear edge 43 up to a front edge 44.

The rear edge 43 is located toward the top of the low portion 10 of the upper 2. The front edge 44 is located in the area of the base 21, and it is attached to the upper 2 by a means that is identical or similar to the means for attaching the lateral 31 and medial 32 edges.

As a result, the slit 13 is blocked, between the lateral 14 and medial 15 quarters, from its base 21 up to the rear edge 43 of the panel 30.

Given that the strip is constantly stretched, independently of the relative position of the lateral 14 and medial 15 quarters, dirt cannot penetrate into the upper 2 in the area of the panel 30 or get wedged in a fold.

The panel 30 can be made from a fabric made of elastic threads, such as rubber, silicone, polyurethane, or the like. Thus, the panel 30 remains stretched between the lateral 14 and medial 15 quarters and facilitates their repositioning after they have been spread apart.

Preferably, the fabric constituting the panel 30 has threads that give it a certain impermeability, such as polyurethane threads. This improves the overall impermeability of the upper 2.

The fabric constituting the panel 30 can also have threads having a low coefficient of friction, such as polytetrafluoroethylene threads. This facilitates the sliding of the tongue 20, lace 24 or dirt with respect to the panel 30.

The fabric constituting the panel 30 can further have threads that can be heat-formed, such as polyethylene threads. This allows one to ensure a better cohesion of the fabric, for example, or to cut out the panel by a system that heats it along the cutout. Ultrasonic cutting, for example, leaves edges that are not raveled.

Figure 3:
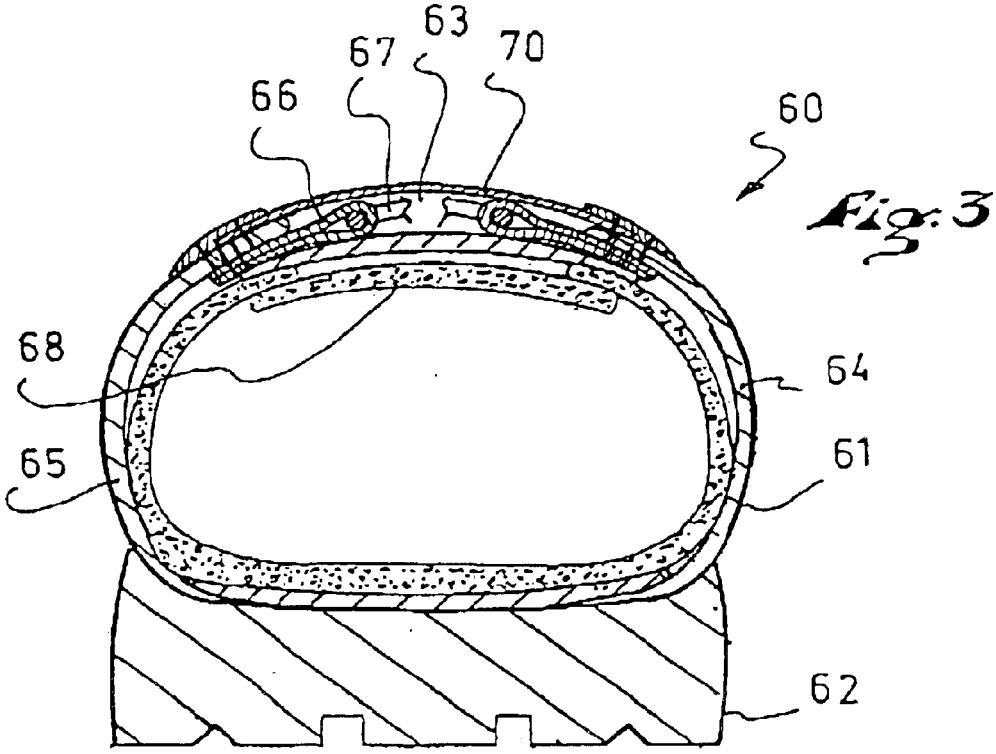
FIG. 3 is a view similar to FIG. 2, according to a second embodiment of the invention.

The second embodiment of the invention is described hereinafter by means of FIG. 3.

For reasons of convenience, only the particularities of this example are emphasized.

A boot 60 has an upper 61 that overlays a sole 62. The upper 61 has a slit 63 that is laterally demarcated by a lateral quarter 64 and by a medial quarter 65.

A tightening means, having keepers 66 and 67, enables tightening the upper in a reversible manner. A tongue 68 is located under the tightening means, between the quarters 64, 65.

An elastic panel 70 blocks the slit 63 at least partially, the panel 70 being stretched between the lateral quarter 64 and the medial quarter 65.

The elastic panel 70 covers the tightening means Compared to the previous panel, the panel according to this example has an additional advantage in that it prevents, sticks, snow or any other object from getting wedged in the lace 24.

Furthermore, the appearance of the boot 60 is different.

Generally speaking, the invention is embodied from materials and according to techniques of embodiment that are known to one skilled in the art.

The invention is not limited to the examples that have been described hereinabove, and it includes all of the technical equivalents that fall within the scope of the following claims.

Particularly, the length of the elastic panel could be different. The panel could rise higher toward the opening 12 of the upper 2, or stop lower. The panel can be provided to not be attached to the upper 2 toward the front of the boot and to be spaced from the base 21 of the slit 13.

Furthermore, the upper could have only a low portion and not a high portion. Or the slit could be located elsewhere than on the upper, for example vertically in the area of the heel.

What is claimed is:

1. A boot comprising:

a sole and an upper overlying the sole, the upper including a low portion and a high portion, said low portion comprising a portion of the upper adapted to receive a foot of a wearer and said high portion comprising a portion of the upper adapted to at least partially surround a lower leg of the wearer;

the upper further including a high opening extended by a slit, the high opening being at an upper end of the high portion of the upper and the slit extending between a lateral quarter and a medial quarter of the upper;

an elastic panel blocking the slit at least partially, the elastic panel being constantly stretched continuous across the slit between the lateral quarter and the medial quarter, independent of differences in distance between the lateral and medial quarters.

2. A boot according to claim 1, wherein the elastic panel extends lengthwise from a rear edge located toward the top of the low portion of the upper, up to a front edge located in the area of a base of the slit.

3. A boot according to claim 2, wherein the elastic panel is attached to the medial quarter from the rear edge of the elastic panel to the front edge of the elastic panel and the elastic panel is attached to the lateral quarter from the rear edge of the elastic panel to the front edge of the elastic panel.

4. A boot according to claim 3, wherein the elastic panel is attached to the medial and lateral quarters by stitches.

5. A boot according to claim 1, wherein the slit extends the opening toward the front.

6. A boot according to claim 1, wherein the panel is made in the form of a fabric made from elastic threads.

7. A boot according to claim 6, wherein the fabric constituting the panel also has threads that give the panel an impermeability.

8. A boot according to claim 6, wherein the fabric constituting the panel also has having a low coefficient of friction.

9. A boot according to claim 6, wherein the fabric constituting the panel also has heat-formed threads.

10. A boot according to claim 1, wherein the elastic panel is attached to the lateral and medial quarters by stitches.

11. A boot according to claim 1, further comprising a tightening means in the form of keepers spread out over the lateral and medial quarters, and a lace which connects the keepers.

12. A boot according to claim 11, wherein the elastic panel is located under the means for tightening the upper.

13. A boot according to claim 11, wherein the elastic panel covers the tightening means.

14. A boot according to claim 11, wherein an upper surface of the elastic panel is exposed when the upper is tightened by said tightening means.

15. A boot according to claim 1, further comprising a tongue extending from a base of the slit up to the top of the upper.

16. A boot according to claim 1, wherein the fabric constituting the panel comprises rubber.

17. A boot according to claim 1, wherein the fabric constituting the panel comprises silicone.

18. A boot according to claim 1, wherein the fabric constituting the panel comprises polyurethane.

19. A boot according to claim 1, wherein the fabric constituting the panel comprises polytetrafluoroethylene.

20. A boot according to claim 1, wherein the upper is flexible to allow forward bending of the lower leg of the wearer, the boot being a snowboard boot.

21. A boot according to claim 1, further comprising a tongue attached to the boot to extend along the slit from a base of the slit, the tongue being separate from the elastic panel and beneath the elastic panel.

22. A boot according to claim 1, further comprising:

a tightening arrangement for applying a tightening force to move the medial and lateral quarters of said upper in a direction toward each other in a tightened position;

wherein the elastic panel is stretched between the lateral quarter and the medial quarter without a foot within the boot; and wherein the elastic panel is stretched between the lateral quarter and the medial quarter with a foot within the boot in the tightened position.

23. A boot according to claim 22, wherein the tightening arrangement comprises a lace and a plurality of keepers on the medial quarter of the upper and a plurality of keepers on the lateral quarter of the upper.

24. A boot comprising:

a sole and an upper overlying the sole, the upper including a low portion and a high portion, said low portion comprising a portion of the upper adapted to receive a foot of a wearer and said high portion comprising a portion of the upper adapted to at least partially surround a lower leg of the wearer;

the upper further including a high opening extended by a slit, the high opening being at an upper end of the high portion of the upper and the slit extending between a lateral quarter and a medial quarter of the upper;

an elastic panel blocking the slit at least partially, the elastic panel being constantly stretched across the slit between the lateral quarter and the medial quarter, independent of differences in distance between the lateral and medial quarters, the elastic panel thereby preventing penetration of foreign bodies into the upper.

25. A boot according to claim 24, further comprising a tongue attached to the boot to extend along the slit from a base of the slit, the tongue being separate from the elastic panel and beneath the elastic panel.

26. A boot according to claim 24, further comprising a device to tighten the upper on the foot of a wearer by applying a tensioning force to the lateral and medial quarters of the upper, the elastic panel having an exposed upper surface when the upper is tightened by said device.

27. A boot comprising:

a sole and an upper overlying the sole, the upper including a low portion and a high portion, said low portion comprising a portion of the upper adapted to receive a foot of a wearer and said high portion comprising a portion of the upper adapted to at least partially surround a lower leg of the wearer;

the upper further including a high opening extended by a slit, the high opening being at an upper end of the high portion of the upper and the slit extending between a lateral quarter and a medial quarter of the upper;

an elastic panel constantly stretched continuous across the slit, independent of differences in distance between the lateral and medial quarters, the elastic panel blocking the slit over most of the low portion of the upper.

28. A boot according to claim 27, further comprising a tongue attached to the boot to extend along the slit from a base of the slit, the tongue being separate from the elastic panel and beneath the elastic panel.

29. A boot according to claim 27, wherein the slit has a forwardmost base, said elastic panel having a front edge affixed to said forwardmost base of the slit and a rear edge positioned proximate a top of the low portion of the upper.

30. A boot according to claim 27, further comprising a device to tighten the upper on the foot of a wearer by applying a tensioning force to the lateral and medial quarters of the upper, the elastic panel having an exposed upper surface when the upper is tightened by said device.

31. A snowboard boot comprising:

a sole;

an upper comprising a medial portion and a lateral portion, said medial and lateral portions extending upwardly from said sole to define a low portion of said upper for receiving a foot of a wearer and extending upwardly beyond said low portion to define a high portion of said upper for receiving a lower leg portion of the wearer;

said medial and lateral portions of said upper defining a slit extending longitudinally in said low portion of said upper and upwardly in said high portion of said upper for facilitating insertion and removal of the wearer's foot within and from said upper;

a tightening arrangement for applying a tightening force to bring said medial and lateral portions of said upper to a tightened position, whereby a tensioning force is applied by said medial and lateral portions of said upper to the wearer's foot within said upper;

an elastic panel attached to said medial and lateral portions of said upper above said sole and extending across said slit to block said slit along at least a majority of a length of said slit;

said medial and lateral portions of said upper being laterally spaced apart in both said tightened position and a non-tightened position; and said elastic panel being tensioned in both said tightened position and said non-tightened position of said upper.

32. A boot according to claim 31, wherein said elastic panel is constantly tensioned continuous across said slit, independent of a relative position of said lateral and medial quarters.

33. A boot according to claim 31, wherein said medial and lateral portions of said upper are laterally spaced apart in a most tightened position of said medial and lateral portions of said upper.

34. A boot according to claim 31, wherein said slit extends rearwardly from a base at a front part of said upper between said medial and lateral portions of said upper.

35. A boot according to claim 31, further comprising a tongue extending rearwardly from a front of said slit above a portion of said upper adapted to be positioned above an instep of the wearer's foot and upwardly to a portion of said upper adapted to be positioned in front of the wearer's lower leg.

36. A boot according to claim 35, wherein said tongue is positioned beneath said elastic panel.

37. A boot according to claim 31, wherein said elastic panel is positioned above said tightening arrangement.

38. A boot according to claim 31, wherein said tightening arrangement comprises a lace and a plurality of lace guides positioned along an edge of said medial portion of said upper and a plurality of lace guides positioned along an edge of said lateral portion of said upper.

39. A boot according to claim 38, wherein said plurality of lace guides include lace guides on both said low portion and said high portion of said upper.

40. A boot comprising:

a sole and an upper overlying the sole, the upper including a low portion and a high portion, said low portion comprising a portion of the upper adapted to receive a foot of a wearer and said high portion comprising a portion of the upper corresponding to an area above an ankle of a wearer of the boot and adapted to at least partially surround a lower leg of the wearer;

the upper further including a high opening extended by a slit, the high opening being at an upper end of the high portion of the upper and the slit extending between a lateral quarter and a medial quarter of the upper;

a tightening device connected to the lateral and medial quarters along a longitudinally extended tightening zone for adjusting a spacing between the lateral and medial quarters to a desired tightening of the boot upon a foot of the wearer;

an elastic panel extending across the slit at least partially within the tightening zone, the elastic panel being stretched between the lateral and medial quarters in both a first tightened position in which the lateral and medial quarters are spaced apart by a predeterminate amount and in a second tightened position in which the lateral and medial quarters are spaced apart by an amount less than the predeterminate amount.

41. A boot according to claim 40, wherein:

the elastic panel is connected along a longitudinally extending edge of the lateral quarter and along a longitudinally extending edge of the medial quarter.

42. A boot according to claim 40, further comprising:

a tongue separate from the elastic panel, an upper surface of the tongue being positioned beneath the elastic panel.

43. A boot according to claim 42, wherein:

the tongue extends rearwardly from a front of the slit to a position rearwardly of an area corresponding to an instep of the wearer's foot.

44. A boot according to claim 43, wherein:

the tongue has an upper end positioned in an area of the high portion of the upper corresponding to a position in front of the wearer's lower leg.

45. A boot according to claim 40, wherein:

a spacing between the lateral and medial quarters is adjustable between a least tightened distance and a most tightened distance, the elastic panel being exposed from above independent of the spacing.

46. A boot according to claim 40, wherein:

the tightening device comprises a lace, a plurality of lace guides extending along the lateral quarter and a plurality of lace guides extending along the medial quarter.

* * * * *